US010322426B2

(12) United States Patent
Shah

(10) Patent No.: US 10,322,426 B2
(45) Date of Patent: Jun. 18, 2019

(54) VIBRATING SIEVING APPARATUS AND A SYSTEM FOR REAL TIME SIEVING

(71) Applicant: Amal Bhupendra Shah, Mumbai (IN)

(72) Inventor: Amal Bhupendra Shah, Mumbai (IN)

( * ) Notice: Subject to any disclaimer, the term of this patent is extended or adjusted under 35 U.S.C. 154(b) by 251 days.

(21) Appl. No.: 15/028,677

(22) PCT Filed: Apr. 22, 2015

(86) PCT No.: PCT/IN2015/050031
§ 371 (c)(1),
(2) Date: Apr. 11, 2016

(87) PCT Pub. No.: WO2015/193919
PCT Pub. Date: Dec. 23, 2015

(65) Prior Publication Data

US 2016/0250653 A1 Sep. 1, 2016

(30) Foreign Application Priority Data

Jun. 20, 2014 (IN) ..... 2004/MUM/2014

(51) Int. Cl.
*B05B 7/14* (2006.01)
*B07B 1/54* (2006.01)
(Continued)

(52) U.S. Cl.
CPC ..... *B05B 7/1445* (2013.01); *B05B 7/1472* (2013.01); *B05B 7/1477* (2013.01);
(Continued)

(58) Field of Classification Search
CPC .... B07B 1/18; B07B 1/22; B07B 1/50; B07B 1/54; B07B 1/55; B07B 4/08;
(Continued)

(56) References Cited

U.S. PATENT DOCUMENTS 4,710,286 A * 12/1987 Mulder ..... B04C 9/00 209/250
2012/0234735 A1* 9/2012 Ichikawa ..... B07B 1/06 209/255
2013/0019970 A1* 1/2013 Kleineidam ..... B05B 7/144 137/565.01

FOREIGN PATENT DOCUMENTS

DE 3920635 A1 1/1991
DE 102012102994 A1 10/2013
(Continued)

OTHER PUBLICATIONS

International Search Report and Written Opinion dated Dec. 22, 2015, in International Application No. PCT/IN2015/050031, 9 pages.

*Primary Examiner* — Charles A Fox
*Assistant Examiner* — Kalyanavenkateshware Kumar
(74) *Attorney, Agent, or Firm* — Rothwell, Figg, Ernst & Manbeck, P.C.

(57) ABSTRACT

The present invention provides a vibrating sieving apparatus and a real time powder sieving system. The apparatus includes a powder pump assembly connected to a vibrating device through a powder suction tube wherein the vibrating device (120) is configured for real time sieving of powder just before spraying. The apparatus further includes a housing (130) connected to the vibrating device (120) wherein the housing (130) includes a sieve section (140) and an anti blinding section (135).

13 Claims, 8 Drawing Sheets

(51) Int. Cl.
*B07B 4/08* (2006.01)
*B07B 13/16* (2006.01)

(52) U.S. Cl.
CPC ..... *B05B 7/1486* (2013.01); *B07B 1/54* (2013.01); *B07B 4/08* (2013.01); *B07B 13/16* (2013.01)

(58) Field of Classification Search
CPC ..... B07B 13/16; B05B 7/1445; B05B 7/1486; B05B 7/1477; B05B 7/1472
See application file for complete search history.

(56) References Cited

FOREIGN PATENT DOCUMENTS

| | | | |
|---|---|---|---|
| EP | 0528755 | A1 | 2/1993 |
| EP | 1580133 | A2 | 9/2005 |

* cited by examiner

VIBRATING SIEVING APPARATUS AND A SYSTEM FOR REAL TIME SIEVING

CROSS REFERENCE TO RELATED APPLICATION(S)

This application is a 35 U.S.C. § 371 National Phase Entry Application from PCT/IN2015/050031, filed Apr. 22, 2015, designating the United States, which claims priority upon Indian Patent Application No. 2004/MUM/2014, filed Jun. 20, 2014. The disclosures of each of the above-referenced applications are herein incorporated by reference in their entirety.

FIELD OF INVENTION

The present invention relates to Powder spray equipments. More particularly, the invention relates to a real time sieving system and a vibrating sieving apparatus with inbuilt anti-blinding system for use in powder spray equipment.

BACKGROUND OF THE INVENTION

Application of protective coating to industrial and commercial products is essential. The utilization of electrostatic powder spray guns for applying these coatings is also well known in the art. Protective coating or powder Coating is dry paint. The finely ground powder particles made from pigment, resin and other additives are given electrostatic charge and sprayed onto a metal part. The parts to be coated are grounded neutral so that the charged particles projected at them adhere to the parts and are held there until melted and fused into a smooth coating in the curing oven.

The largest volume of powder coating is applied by electrostatic spray using equipment especially designed for powders. Other methods of application are fluidized powder bed dipping, electrostatic fluidized bed and flocking. This electrostatic application of powder is made possible because powders, being generally non-conductive, will retain an electrostatic charge and cling to a grounded substrate until melting in the cure oven. The charge may be positive or negative, but negative is the most efficient for most materials and is most widely used.

A typical electrostatic spray application system has a container for powder storage, delivery system and a charging system. The basic pieces of a typical equipment that make up a spray unit are a feed hopper or powder box container, a powder spray gun connected to a powder suction pump, an electrostatic power source (cascade), the controls. These components are connected by hoses and cables and all the necessary regulators and fittings to complete the package. The feed hopper is designed the same as a fluidized tank.

In order to apply a powder coating over a specific surface in a uniform pattern a charge is supplied to the material. The powder must be charged to adhere. In a corona gun the powder particles are passed through a charging field by the delivery system and attracted to the object to be coated which is earthed to the ground.

Another method of spray application is the tribo-charging gun. In a tribo-charging gun, the powder particles are charged by frictional contact with the materials inside the gun body.

The function of the powder spray gun is to shape and direct the flow of the powder, help to control the spray pattern shape and size, and impart an electrostatic charge to the powder.

Powder output and charge, and therefore powder deposition efficiency are controlled by the delivery system and the charging system. The delivery system sucks and transports the powder from the container to the gun tip and out of the spray gun. The charging system charges the powder material so that it will be attracted to the part and stick to the part surface until it is cured. The pneumatic controls and the voltage control are very important elements for achieving good transfer efficiency.

Powder is sprayed from the tip of the gun of the powder spray equipment. This powder is charged. This charged powder is sprayed onto the work-piece which needs to be powder coated. This charged powder which is sprayed adheres to the work-piece due to the electrostatic charging. The over sprayed powder is then collected in a chamber and recovery system such as powder spray cum recovery booth. The ratio of the amount powder adhering to the work-piece to the amount of powder sprayed out of the powder spray equipment is called transfer efficiency.

Moisture and other factors make the powder coagulated and lumpy in spite of the best prior sieving. Powder is hygroscopic and moisture can be picked up by the powder while lying in the powder container or while it is being transported from the recovery units back to the powder container for re-use. This coagulation of the moist powder is a big source of an un-even powder coat, poor transfer efficiency, poor flow and poor finish. Powder is collected in the recovery of the powder spray cum recovery booths. At this stage powder tends to contaminate with dust and other particles. This powder has to then be transported back to the master powder container either by pneumatic or mechanical means. This also sometimes leads to contamination of the recovered powder. The powder is also subject to exposure to moisture and being hygroscopic it often does pick up this moisture and get lumped. Since, the powder is transported in boxes and during transportation it gets compacted in the box itself, the powder needs to be sieved prior to use.

Normally this sieving is done by means of vibrating sieves. The vibrating methods generally followed are pneumatic, electric, ultra-sonic, mechanical or any other means. After this sieving the powder again needs to be transported for spraying to the master powder container to which the powder pumps and spray guns are connected. This transportation is once again a source of contamination and coagulation. Thus, you can still have contaminated and lumped powder prior to spraying, in spite of the costly and time consuming sieving operations.

The standard method of powder sieving is to pass the powder through a sieve device and the sieving takes place due to a vibratory or gyratory or rotary motion of the sieves using known means such as pneumatic, electric, mechanical or ultrasonic methods. These sieve machines may be placed under the recovery system or may be separately placed outside of the powder recovery system. They can be quite expensive, bulky and complex in operation. They need a separate area for placement which has to be accommodated in the plant design. The sieve machines after a while have to be cleaned periodically either manually or by designing some automated method and this is an expensive and cumbersome process.

In case of the sieve machines integrated with the recovery units or placed under the recovery zone or placed separately besides the recovery system, the powder after sieving has to be collected or transported into the master container to which the powder output device is connected. The sieving and transportation of the sieved powder to the container for spraying involves an additional procedure and is quite cumbersome.

In case of Batch sieve or stand alone sieve machines, the powder after collection has to be manually taken to the sieving machines and then after sieving the powder has to be recollected and transported to the master container. The transportation of the powder to the sieve and collection and re-transportation to the master container for spraying involves costly and labour intensive operations such as pumping devices manual transportation, human labour, possible spillage and contamination.

In spite of the best sieving of the powder prior to transportation to the master spray container for further spraying, impurities can creep in during this process. Powder in the master spray container often still gets contaminated or even coagulated due to various reasons such as absorption of moisture as it is continuously fluidized for long periods without being consumed especially since the powder is hygroscopic in nature. Another point of contamination is that the powder remaining stagnant overnight or change of shift. In such case sieved powder is subsequently contaminated gets sprayed in the contaminated form.

Further, in conventional existing powder coating systems, the fresh and recollected powder has to be transported (either manually or automatically) to bulky and expensive sieving machines. It was conventional wisdom to have large and bulky sieves to handle the quantity of powder to be sprayed. The sieved powder needs to be re-transported to the main spray powder container or box for further spraying from the gun.

It is therefore required to formulate a mechanism to overcome the problems associated with the prior art machines.

SUMMARY OF THE INVENTION

Accordingly, the present invention provides a vibrating sieving apparatus for smooth flow of powder in powder spray equipments. The apparatus includes a powder pump assembly having a suction port for sucking the powder from a powder container through a suction path of a powder suction tube, a vibrating device connected to the suction port of the powder pump assembly through the suction tube wherein the vibrating device is configured for real time sieving of powder just before spraying, a housing connected to the vibrating device wherein the housing includes a sieve section and an anti blinding section, wherein the anti-blinding section is configured for preventing clogging of the sieve section for ensuring continuous flow of freshly sieved smooth flowing powder at the suction port of the powder pump assembly.

In one embodiment, the sieve section includes at least one sieve mesh and anti-blinding section includes at least one anti-blinding pellet wherein the at least one anti-blinding pallet is placed between the housing and at least one sieve mesh.

In another embodiment, the sieve section includes an inner sieve mesh and an outer sieve mesh and the anti-blinding section includes a plurality of anti-blinding pellets wherein the plurality of anti-blinding pellets is placed between the inner sieve mesh and the outer sieve mesh.

In yet another embodiment, the sieve section includes a plate with holes and at least one sieve mesh and the anti-blinding section includes a plurality of anti-blinding pellets wherein the plurality of anti-blinding pellets are placed between the plate and the at least one sieve mesh.

In an embodiment, the present invention provides a vibrating sieving apparatus for smooth flow of powder in powder spray equipments. The apparatus includes a vibrating device with an integrated powder pump assembly wherein the integrated powder pump assembly has a suction port for sucking the powder from a powder container and the vibrating device is configured for real time sieving of powder just before spraying; and a housing connected to the vibrating device wherein the housing includes a sieve section and an anti blinding section, wherein the anti-blinding section is configured for preventing clogging of the sieve section to ensure continuous flow of freshly sieved smooth flowing powder at the suction port of the powder pump assembly.

In an embodiment the present invention provides a real time powder sieving system. The system includes at least one vibrating sieving apparatus having at least one powder pump assembly with a suction port for sucking powder from a powder container through a suction path of a powder suction tube; and at least one spray gun connected to the vibrating sieving apparatus through a discharge end of the at least one powder pump assembly wherein the powder pump assembly has a compressed air inlet which creates a suction to force the powder along with air present around powder particles to pass through a sieve section and an anti-blinding section of the vibrating sieving apparatus thereby ensuring that powder is being sucked as freshly sieved separated particles.

In another embodiment the present invention provides a real time powder sieving system including at least one vibrating sieving apparatus having a plurality of powder pump assembly with a suction port for sucking powder from a powder container through a suction path of a powder suction tube; and a plurality of spray guns connected to the at least one vibrating sieving apparatus through a discharge end of each of the plurality powder pump assembly wherein each of the plurality of powder pump assembly have a compressed air inlet which creates a suction to force the powder along with air present around powder particles to pass through a sieve section and an anti-blinding section of the at least one vibrating sieving apparatus thereby ensuring that powder is being sucked as freshly sieved separated particles.

DESCRIPTION OF THE INVENTION

Figure 1:
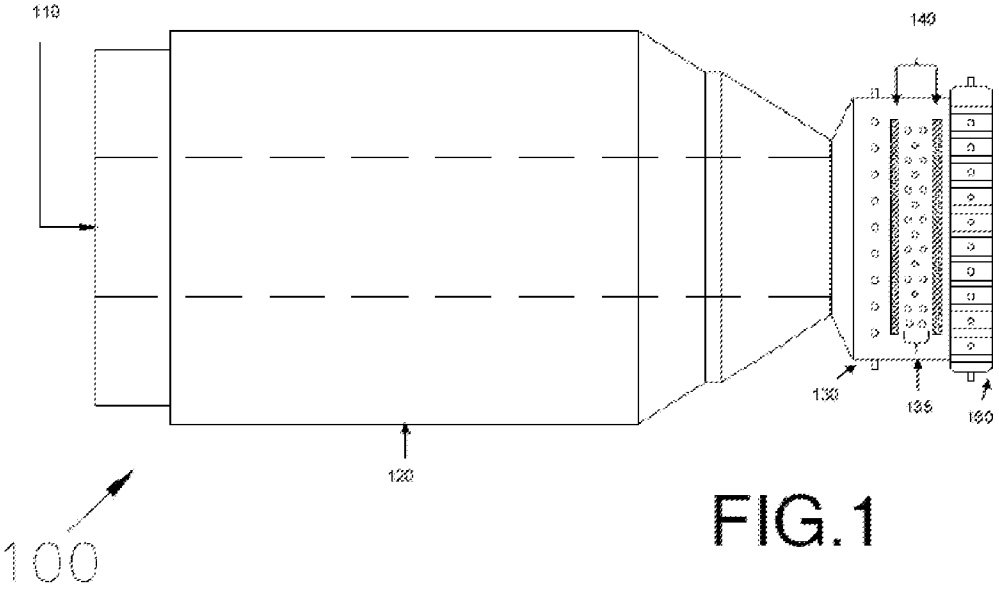
FIG. 1 shows an assembled view of a vibrating device a vibrating sieving apparatus, the vibrating device connected to a housing having a sieve section and an anti-blinding section in accordance with an embodiment of the invention.

The various embodiments of the present invention provide a vibrating sieving apparatus for powder spray equipment and a real time powder sieving system.

In the following description, for purpose of explanation, specific details are set forth in order to provide an understanding of the invention. It will be apparent, however, to one skilled in the art that the invention may be practiced without these details. One skilled in the art will recognize that embodiments of the present invention, some of which are described below, may be incorporated into a number of systems. Structures and devices shown in the figures are illustrative of exemplary embodiments of the invention and are meant to avoid obscuring the invention. Furthermore, connections between components and/or modules within the figures are not intended to be limited to direct connections. Rather, these components and modules may be modified, re-formatted or otherwise changed by intermediary components and modules.

References in the specification to "one embodiment" or "an embodiment" means that a particular feature, structure, characteristic, or function described in connection with the embodiment is included in at least one embodiment of the invention. The appearances of the phrase "in one embodiment" in various places in the specification are not necessarily all referring to the same embodiment.

This invention relates to a vibrating sieving apparatus with inbuilt sieving and anti-blinding system and connected to spraying apparatus, for ensuring a freshly sieved, uniform, smooth and even spray of powder emitted from a powder spray gun(s).

The present invention provides a vibrating sieving apparatus to ensure smooth and even flow of powder from even coagulated and impurity laden powder from the master spray container without external or separate sieving. By placing the present invention apparatus at the suction of the powder pump, the powder is forced through the sieve(s) during suction for output. It is this suction which is used to force powder through the sieve i.e it is not gyratory or rotary or vibrating motion which is used to move powder through the sieve.

In an embodiment, the vibration enables inbuilt sieve and anti blinding section to ensure continuous operation without the mandatory stoppage downtime for cleaning. The lump breaker mechanism in the present apparatus assists lumped powder disintegration.

The present apparatus ensures that the particles are separated and freshly sieved and immediately presented to the spray device such as powder spray gun and the particles are thus charged better. This is due to the smaller mass of the distinctly separated powder particles versus lumped powder particles. Thus making them more tenable to easily accepting an electrostatic charge. The distinctly separated powder particle ensures a superior powder cloud emitted out of a powder spray gun and a more even and smooth powder flow with better uniformity and improved deposition efficiency.

This present apparatus also eliminates the need for expensive bulky and cumbersome external sieving systems.

The present invention provides miniaturized sieving machine with a suitable anti clogging mechanism. This miniature sieving apparatus is connected to the suction of the powder pump so that the powder that is sucked for spraying is freshly sieved powder.

In an advantageous aspect, the vibrating device with a pair of sieves with ensconced anti blinding pellets, when connected to the suction end of the powder output device such as a powder pump—which there on transfers the powder to the powder spray gun—ensures that the powder is freshly sieved just prior to spray.

The exemplary embodiments of the present invention shall now be disclosed with reference to the drawings.

FIG. 1 shows an assembled view 100 of components of a vibrating sieving apparatus including a vibrating device connected to a housing having a sieve section and an anti-blinding section in accordance with an embodiment of the invention. The apparatus includes an opening connection 110 for suction port of a powder pump, a vibrating device 120 devised to be connected to a housing 130, an anti-blinding section 135, a sieve section 140 connected to the housing 130, and a housing holder ring 160 with prongs.

Figure 1A:
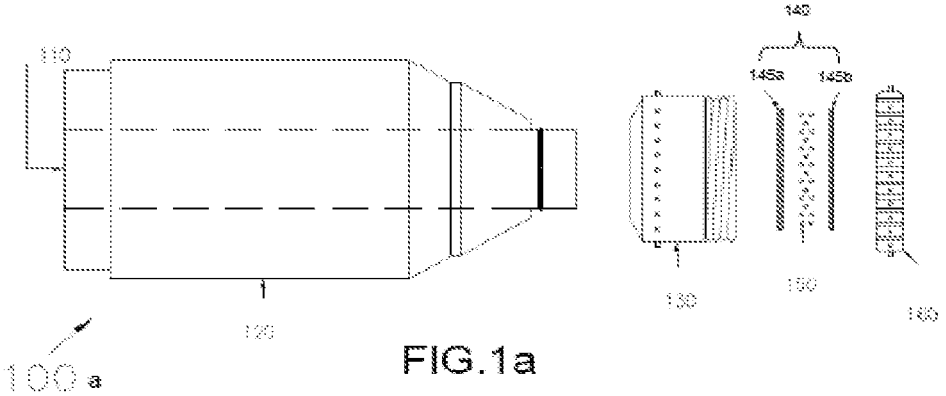
FIG. 1*a* shows an exploded view of components of the vibrating sieving apparatus having the vibrating device connected to a housing having a sieve section and an anti-blinding section having at least two sieve meshes in accordance with an embodiment of the invention.

Referring to FIG. 1*a* shows an exploded view 100*a* of components of the vibrating sieving apparatus having the vibrating device connected to a housing having a sieve section and an anti-blinding section in accordance with an embodiment of the invention.

In a preferred embodiment, the anti-blinding section 135 of the apparatus includes a plurality of anti-blinding pellets 150 placed between an inner sieve mesh 145*a* and an outer sieve mesh 145*b* of the sieve section 140 as shown in FIG. 1*a*.

Figure 1B:
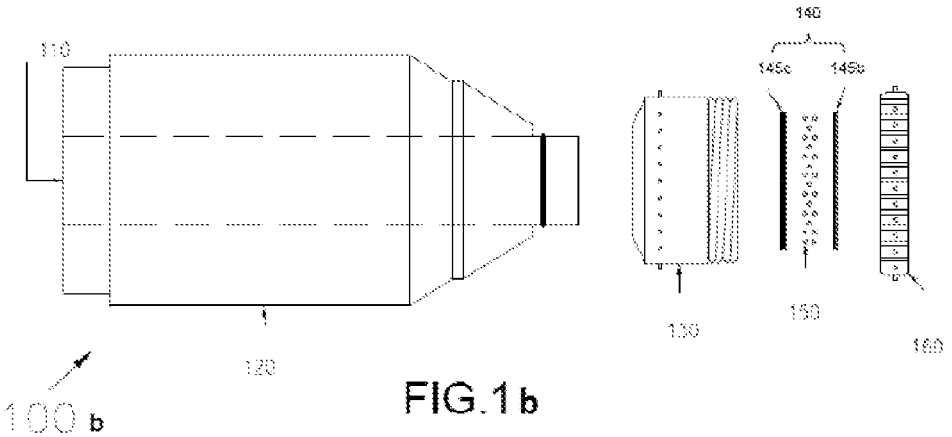
FIG. 1*b* shows an exploded view of components of the vibrating sieving apparatus having the vibrating device connected to a housing having a sieve section and an anti-blinding section, the sieve mesh having at least one sieve mesh and one plate in accordance with an embodiment of the invention.

In another embodiment, the anti-blinding section 135 of the apparatus includes a plurality of anti-blinding pellets 150 placed between a plate 145*c* with holes and at least one outer sieve mesh 145*b* of the sieve section 140 as shown in exploded view 100*b* of FIG. 1*b*.

Figure 1C:
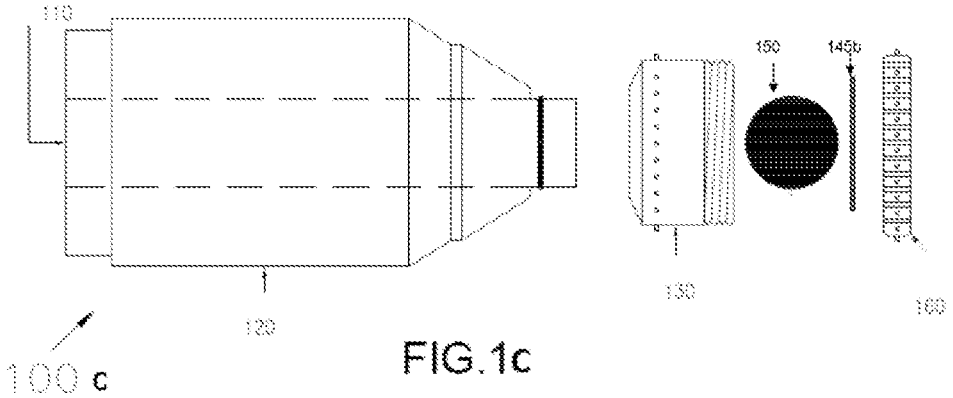
FIG. 1*c* shows an exploded view of components of the vibrating sieving apparatus having the vibrating device connected to a housing having a sieve section and an anti-blinding section, the sieve section having at least one sieve mesh in accordance with an embodiment of the invention.

In an embodiment, the anti-blinding section 135 of the apparatus includes at least one anti-blinding pellet 150 between the housing 130 and at least one sieve mesh 145*b* of the sieve section 140 as shown in exploded view 100*c* of FIG. 1*c*.

In an embodiment, the anti blinding pellets 150 are preferably made of steel of varying sizes. It will however be apparent to a person skilled in the art that the material of the anti blinding pellets may be metallic or non metallic.

In an embodiment, the housing holder ring 160 may have pronged shaped powder lump breakers on body of the apparatus or maybe placed just at the mouth of the suction path of the powder pump assembly.

Figure 2:
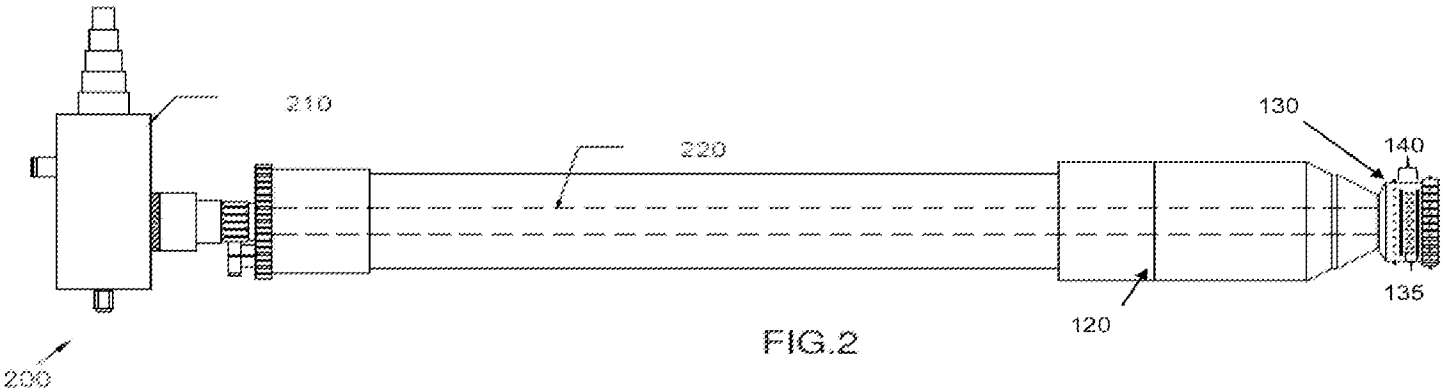
FIG. 2 shows a vibrating sieving apparatus with inbuilt sieve section and anti blinding section connected with a powder pump assembly in accordance with an embodiment of the invention.

The vibrating sieving apparatus 200 with inbuilt sieve section and anti blinding section is connected to the suction port of the powder pump assembly 210 as shown in FIG. 2 in accordance with an embodiment of the present invention. The apparatus 200 includes the powder pump assembly 210 having a suction port for sucking the powder through a suction path of a powder suction tube. The apparatus requires only compressed air to vibrate it. The anti blinding mechanism of the apparatus 200 ensures that powder and its impurities shall not clog the sieve mesh holes, thus ensuring clean, freshly sieved powder to enter the suction port of the powder pump assembly. Thus this apparatus 200 ensures a very smooth flow of powder from the powder spray equipment. This apparatus 200 eliminates expensive and cumbersome separate sieving of the powder before it is used in powder spray applications. In an advantageous aspect, the apparatus 200 also overcomes the need to have costly sieving methods such as electric driven sieving or ultrasonic sieving or similar.

In an embodiment the anti-blinding section 135 having the anti-blinding pellets 150 prevents clogging that occurs due to powder and its impurities for ensuring clean, freshly sieved powder to enter the suction port of the powder pump assembly 210.

In an embodiment, the vibrating device 120 is built with a powder suction tube 220 for the powder to be sucked in by the powder pump assembly 210.

In an embodiment the vibrating device 120 is connected to the powder suction tube of the powder pump assembly 210.

In an embodiment, the shape of the vibrating device 120 is conical, or cylindrical or rectangular or cuboid or any such other geometrical shape without departing from the scope of invention.

In one embodiment the vibrating device 120 is a pneumatic vibrator.

Referring to FIG. 1*a* and FIG. 2 the sieve meshes (145*a*, 145*b*) of the sieve section 140 are placed at the suction end of the vibrating device 120 just at the mouth of the powder suction in accordance with an embodiment of the invention. This is to ensure that all the powder being sucked in by the powder pump assembly 210 of the powder spray equipment shall be now sieved at the time of this suction. The outer mesh 145*b* and the inner mesh 145*a* can be of the same or different hole sizes and hole quantity. Thus, the powder particles are separated just prior to spray and impure large particles shall not enter the suction of the powder pump assembly 210.

Figure 2A:
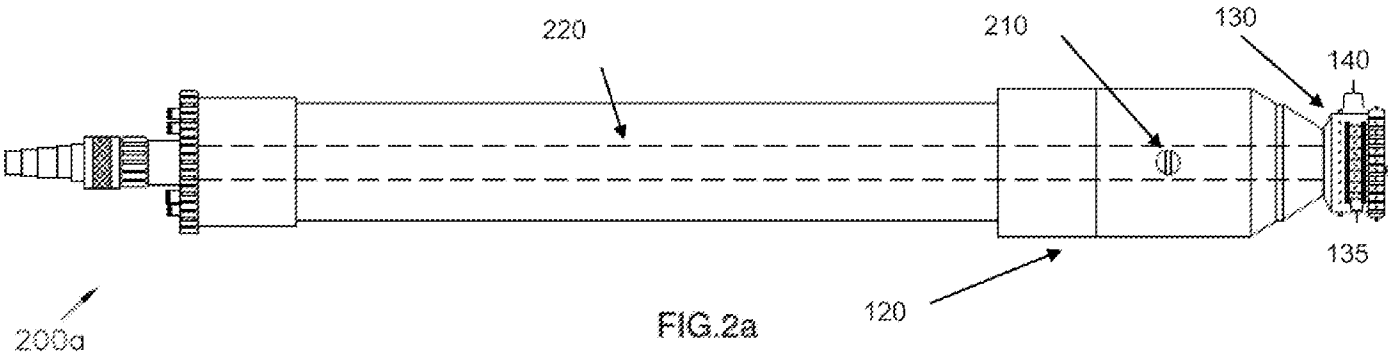
FIG. 2*a* shows a vibrating sieving apparatus with inbuilt sieve section and anti blinding section with integrated powder pump assembly in accordance with an embodiment of the invention.

In an embodiment the vibrating sieving apparatus 200*a* with integrated powder pump assembly of the powder spray equipment is as shown in FIG. 2*a*.

In an embodiment, the pellets 150 are freely movable and may be of the same or of different size.

The housing (130) is preferably made of plastic designed to hold the sieve meshes (145*a*, 145*b*) of the sieve section 140 and to ensure that the pellets 150 of the anti-blinding section 135 are contained within the confines of the plastic housing and the two sieve meshes (145*a*, 145*b*), while also ensuring that the pellets are freely moveable within.

In an embodiment, the said apparatus 200 is either portable or stationary.

In an embodiment of the present invention, the vibrating motion of the apparatus 200 vibrates entire assembled sieve apparatus which is immersed within the powder at the suction end of the powder pump.

Figure 3:
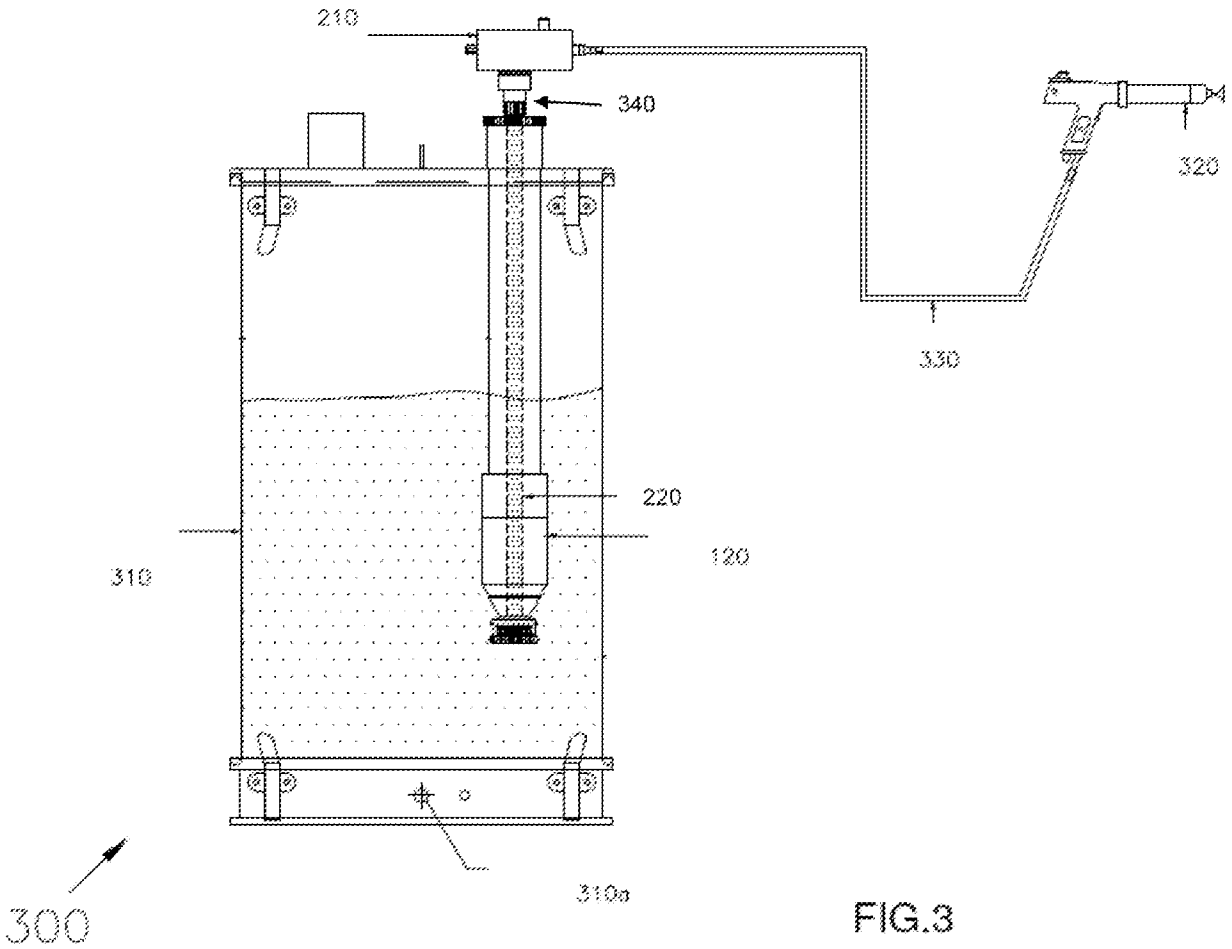
FIG. 3 shows a real time powder sieving system including one spray gun connected to a vibrating sieving apparatus having a powder pump assembly with a suction port for sucking powder from a powder container through a suction path of a powder suction tube in accordance with an embodiment of the invention.

In an embodiment, the housing 130 which may have lump breaker prongs placed at the entry point to assist in breakage of powder which may be lumped and coagulated in the powder container as shown in FIG. 3 and thus present less lumped or un-lumped powder to the sieve at the suction mouth of the said apparatus.

In an embodiment, the housing 130 may be made partially or wholly of a different material either metallic or non-metallic. The powder suction path could also include a magnetic zone so as to trap very fine ferrous particles which may pass through the sieve. Also the prongs on the housing 130 may be made of a different material than the preferred embodiment which can also be metallic or non-metallic. Also, further the housing may or may not have the prongs on them. Numerous modifications and adaptations may be made thereto without departing from the scope of invention.

Figure 3A:
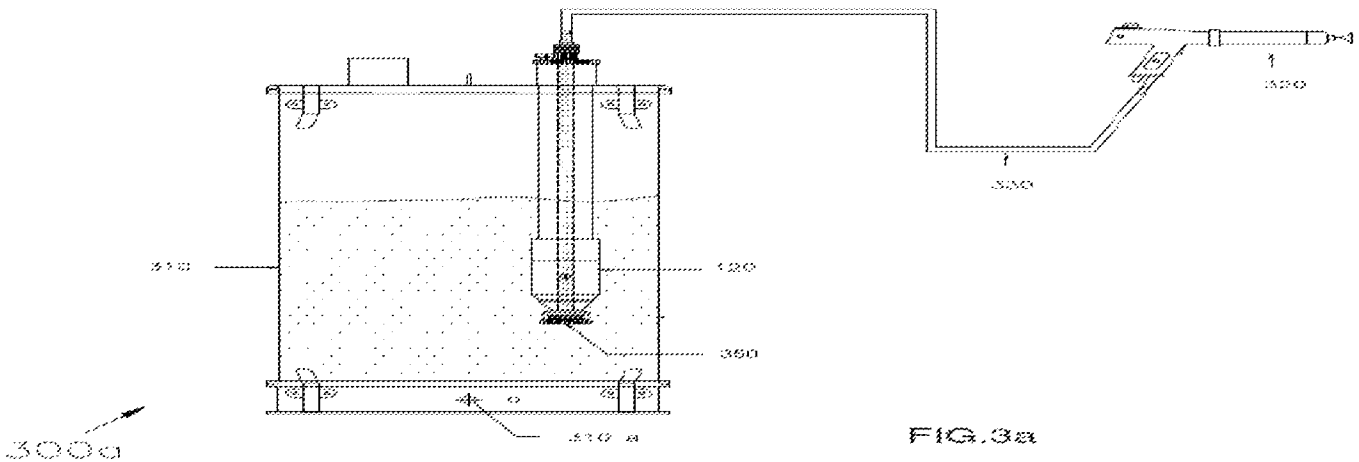
FIG. 3*a* shows a real time powder sieving system including one spray gun connected to a vibrating sieving apparatus having an integrated powder pump assembly with a suction port for sucking powder from a powder container in accordance with an embodiment of the invention.

Referring to FIG. 3*a* real time powder sieving system 300 including one spray gun connected to a vibrating sieving apparatus having a powder pump assembly with a suction port for sucking powder from a powder container through a suction path of a powder suction tube is shown in accordance with an embodiment of the invention. The system 300 includes container 310 with compressed air inlet 310*a*, the apparatus 200 submerged in container 310 and connected by the powder suction tube 220 to suction port 340 of powder pump assembly 210, a powder spray gun 320 connected to the powder pump assembly 210 via powder hose 330.

Referring to FIG. 3*a* a real time powder sieving system 300*a* including one spray gun connected to a vibrating sieving apparatus having an integrated powder pump assembly with a suction port for sucking powder from a powder container is shown in accordance with an embodiment of the invention. The integrated pump having the suction port 340 and a suction end 350 for sucking the powder. It will however be apparent to a person skilled in the art that the powder container may be a bag of powder or a box of powder or a hopper or any other container in which the powder is placed.

Figure 3B:
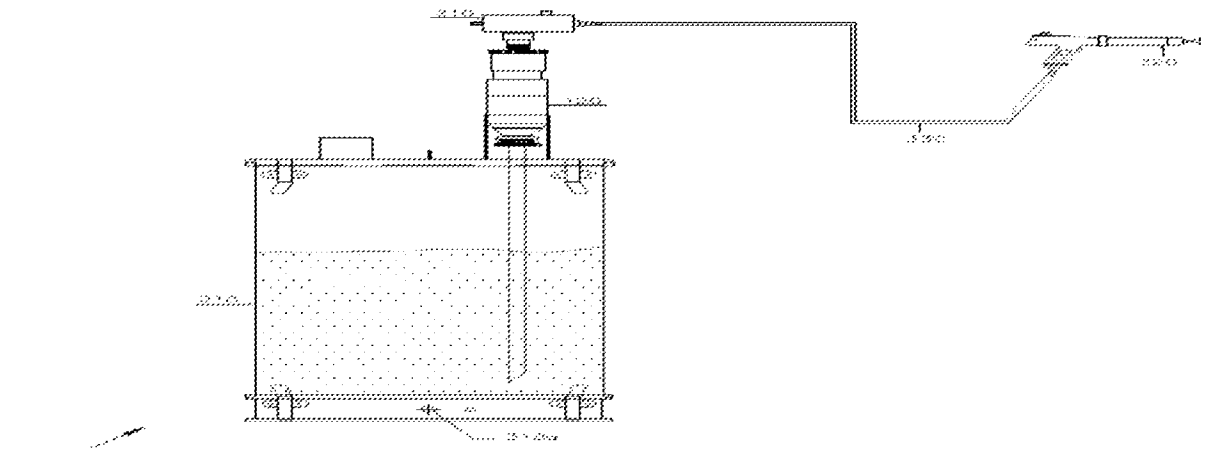
FIG. 3*b* shows a real time powder sieving system including at least one vibrating sieving apparatus placed anywhere outside the powder container in accordance with an embodiment of the invention.

Referring to FIG. 3*b* a real time powder sieving system 300*b* including at least one vibrating sieving apparatus placed anywhere outside the powder container is shown in accordance with an embodiment of the invention. The vibrating sieving apparatus 200 has the powder pump assembly or an integrated powder pump assembly.

In an embodiment, the powder, along with air present around the powder particles, is forced to pass through the sieve meshes (145*a*, 145*b*) as it is being sucked at the suction end. The powder passes through one or multiple sieves and this ensures that that powder is being sucked as separated particles. The suction tube 220 is connected to the vibrating device 120 in a way so as to ensure that the separated powder particles is forced to pass through the sieve meshes (145*a*, 145*b*), thus in turn ensuring the sieving of the powder being sucked in.

The suction end of the said apparatus 200 may be immersed within the powder of the container 310 and the discharge end of the said apparatus 200 may be connected either directly or by some flexible means to the powder spray gun 320 from which the powder flows out onto the work-piece.

The pellets 150 jumps within the confines of a zone having at least one mesh of the sieve section 140. The vibrating motion makes the pellets 150 bounce around and hit or vibrate the sieve thus dislodging particles which can clog the sieve. The colliding motion of the pellets 150 within the sieve meshes dislodges any stuck powder and impurity particles clinging to or within the fine holes of the at least one sieve mesh, thus this ensures continuously self cleaning of the said apparatus 200.

In an embodiment, the sieve mesh (145*a*, 145*b*) either partially or wholly, may be made in a different material either metallic or non-metallic. It is also possible to use the pellet 150 ensconcing system as only one being a sieve mesh (145*b*) and the other just some kind of an obstruction such as a plate (145*c*) with at least one hole which is small enough to contain the pellets within the ensconcing zone and hence bounce around without being sucked away along with the powder. The pellets 150 are thus confined within their chamber in a way so as to hit or vibrate the sieve for dislodging particles which can clog the sieve. Modifications and adaptations may be made thereto without departing from the scope of invention.

In another embodiment, it is also possible to use the pellet 150 ensconcing system as only one being a sieve mesh and anti blinding pellets without the second mesh or obstruction plate. The pellet 150 may by sufficiently large or sufficiently heavy in a way so as they shall not be sucked away along with the powder.

Figure 4:
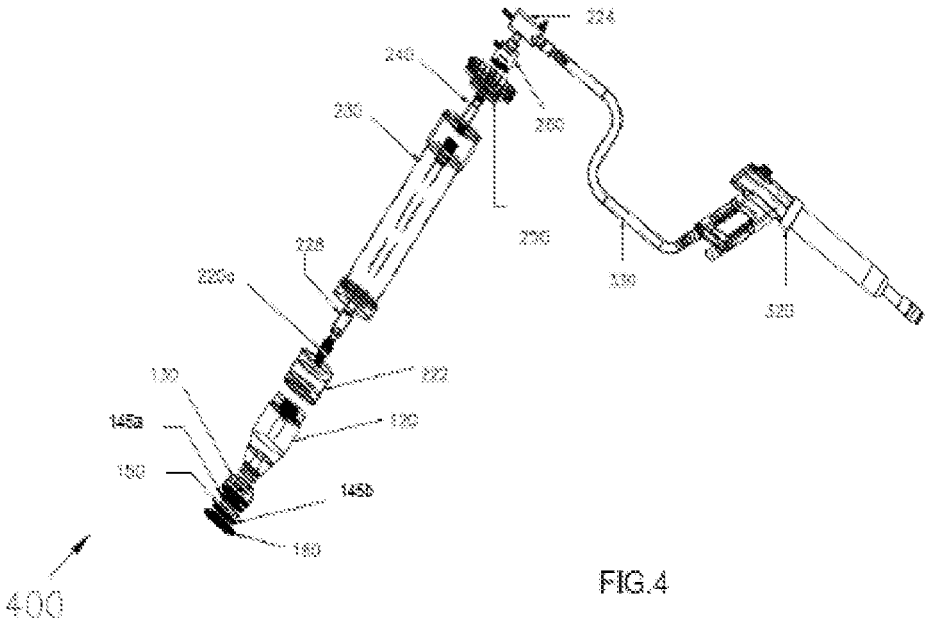
FIG. 4 shows an exploded view of a vibrating sieving apparatus with a powder pump assembly and powder spray gun in accordance with an embodiment of the invention.

Referring to FIG. 4, an exploded view 400 of the vibrating sieve apparatus 200 connected with the powder spray gun 320 by powder pump assembly 210. The pump assembly 210 includes a rubber bellow 222, a powder pump 224, a pump holder 226, a connection pipe 228 accommodating a bottom connector 220*a*, an outer cover 230 covering the suction tube 220, a connector nozzle 240 at the base of the cover 230, a top lock nut 250 and a pump holder 260. The powder spray gun 320 is connected to the pump assembly 210 via powder hose 330.

In an embodiment the suction tube 220 and the bottom connector 220*a* is made of plastic. It will however be apparent to a person skilled in the art that the material of suction tube 220, bottom connector 220*a* may be metallic or non metallic as well.

In an embodiment the connector nozzle 240 is made of aluminum. It will however be apparent to a person skilled in the art that the material nozzle 240 may be metallic or non metallic as well.

Figure 4A:
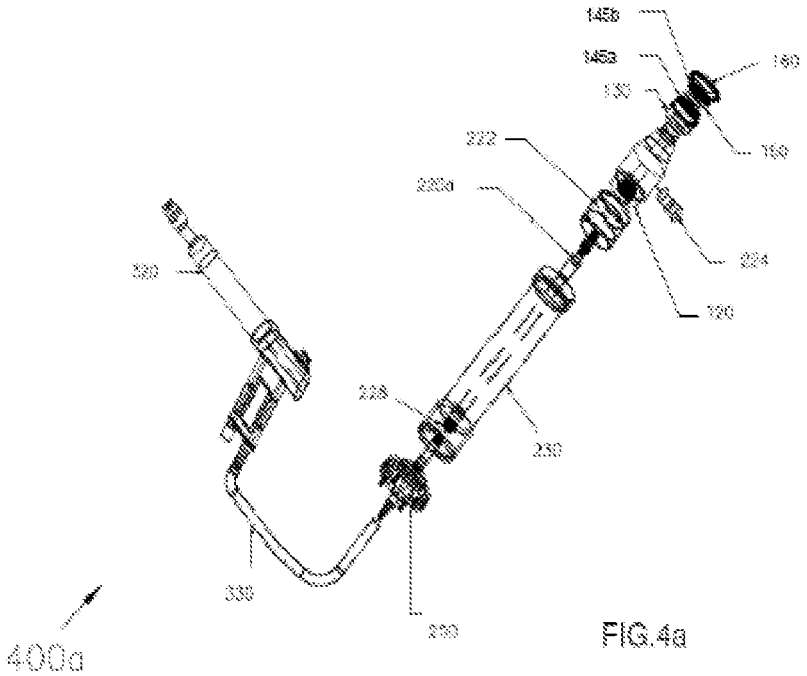
FIG. 4*a* shows an exploded view of a vibrating sieving apparatus with integrated powder pump and connected to a powder spray gun in accordance with an embodiment of the present invention.

Referring to FIG. 4*a* an exploded view 400*a* of the apparatus 200 with an integrated powder pump assembly 210 is shown with the powder spray gun connection 320 in accordance with an embodiment of the invention.

Figure 5:
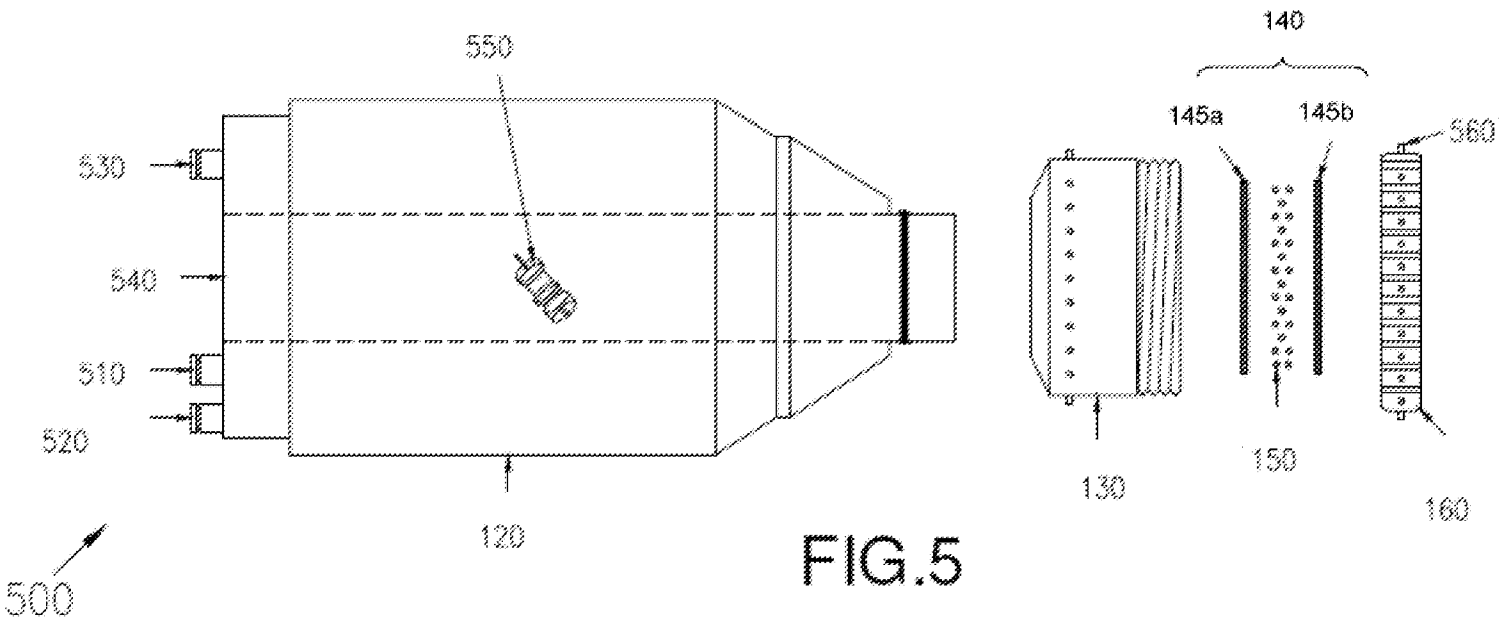
FIG. 5 shows an exploded view of the components of the vibrating sieving apparatus with integrated powder pump in accordance with an embodiment of the invention.

In one embodiment of the present invention the vibrating device 500 as shown in FIG. 5. The vibrating device 500 includes at least one port 510 for dosing air in, at least one port 520 for vibration air in, at least one port 530 for conveying air in, an opening 540 for powder out pipe and a powder pump flow Controller 550. The powder pump flow Controller 550 of the powder spray equipment is integrated within the vibrating device 120. The suction end of the said apparatus 200 may be immersed within the powder of the container and the discharge end of the said apparatus 200 may be connected either directly or by some flexible means to the powder spray gun from which the powder flows out onto the work-piece.

In another embodiment, the said apparatus can have different vibrating methods such as those with electric, ultra-sonic, mechanical or any other means and that numerous modifications and adaptations may be made thereto without departing from the spirit and scope of invention.

In an embodiment, the said apparatus 200 can be placed anywhere in the powder suction path including within, around, beside, above or under the powder pick up tube or suction device or even in the output side of the powder pump 224 such that the air-powder mix is forcefully propelled through the sieve(s) instead of being sucked through the sieve(s) (145*a*, 145*b*).

In yet another embodiment, the vibrating device 120 of the said apparatus 200 can be individually portable and may be assembled in a different position within the powder container 310 or external to the powder container 310 and that numerous modifications and adaptations may be made thereto without departing from the scope of invention.

Figure 6:
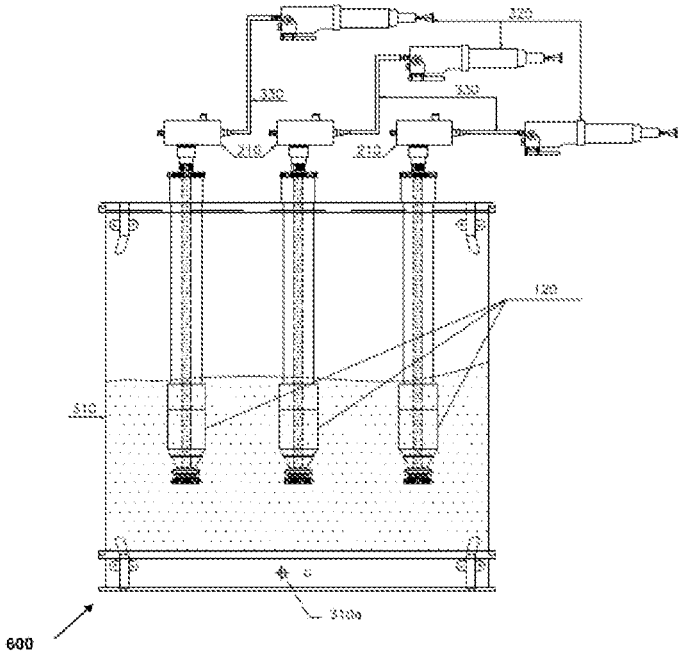
FIG. 6 real time powder sieving system having a plurality of vibrating sieving apparatus connected to a plurality of powder spray guns for spraying powder in accordance with an embodiment of the invention.
Figure 6A:
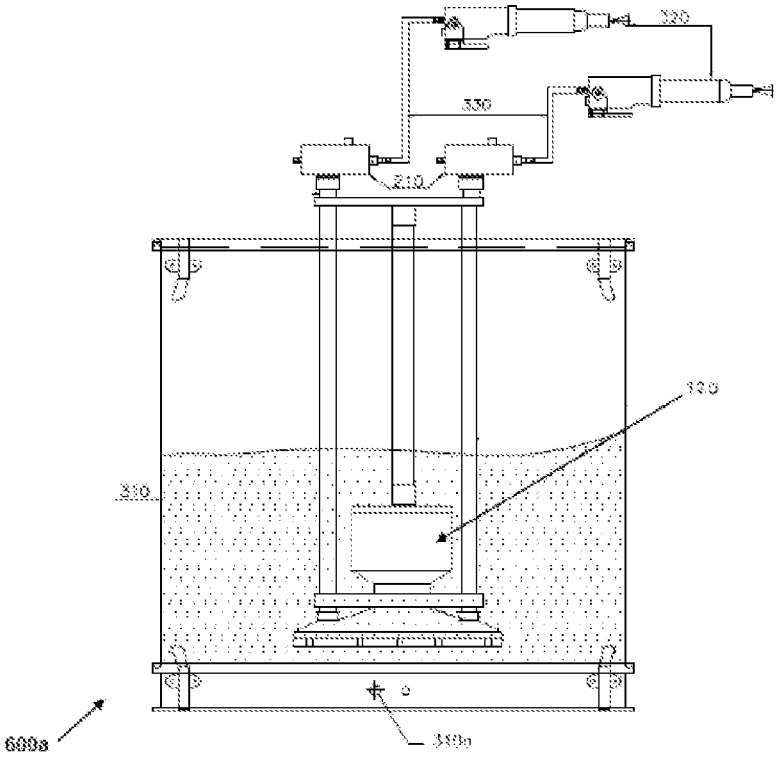
FIG. 6*a* shows a real time powder sieving system having a vibrating sieving apparatus with a plurality of powder pump assembly connected to a plurality of powder spray guns for spraying powder in accordance with an embodiment of the invention.

Referring to FIG. 6*a* real time powder sieving system 600 having a plurality of vibrating sieving apparatus connected to a plurality of powder spray guns for spraying powder is shown in accordance with an embodiment of the invention.

Referring to FIG. 6*a* a real time powder sieving system 600*a* having a vibrating sieving apparatus with a plurality of powder pump assembly connected to a plurality of powder spray guns for spraying powder is shown in accordance with an embodiment of the invention.

The vibrating device 120 may be used for one individual powder spray gun 320 or for simultaneous use with a multi powder spray gun system. Herein plurality of apparatus may be used for the spray from plurality of individual powder guns 320 (FIG. 6), or single collective apparatus may be used for spray of powder from multiple powder spray guns (FIG. 6*a*). In a collective apparatus, the number of vibrating devices 120 may be one or many or the number of sieve meshes (145*a*, 145*b*) may be one or many.

In the said apparatus, the sieve mesh housing 130 can be easily disassembled. Thus, colour change is very simple as cleaning individual components are very quick and easy.

Further the entire said apparatus can be connected to the suction end powder output device via rigid or flexible means such as a flexible tube. The said apparatus may be immersed within the powder in the container.

Further the said apparatus embodiments can be portable (for eg. hand held) or stationary (for eg. fixed to or placed on any object.) The components of the said apparatus such as the vibrator, sieve meshes and the pellets can be individually portable (for eg. hand held) or stationary (for eg. fixed to or placed on any object.)

In an advantageous aspect, the apparatus of the present invention ensures smooth and even flow of powder from even coagulated and impurity laden powder which is put into the master spray container without sieving. By using the present invention the powder is freshly sieved just prior to output. Further, the inbuilt anti blinding system ensures continuous operation without the frequent stoppage down-time for cleaning. The lump breaker mechanism in the present apparatus assists lumped powder disintegration.

The present apparatus ensures that in the freshly sieved powder is free of large impurities and the powder particles are distinctly separated and presented to the charging device such as powder spray gun and the particles are thus charged better resulting in better transfer efficiency. This is due to the smaller mass of the powder particle versus lumped powder particles. Thus, making them more tenable to easily accepting an electrostatic charge. The distinctly separated powder particle ensures a superior powder cloud emitted out of a spray gun and a more even and smooth powder flow with better uniformity and improved deposition efficiency.

The foregoing description of the invention has been set merely to illustrate the invention and is not intended to be limiting. Since, modifications of the disclosed embodiments with reference to the material, design and functional features of each component of the machine, incorporating the spirit and substance of the invention may occur to person skilled in the art, the invention should be construed to include everything within the scope of the appended claims.

I claim:

1. A vibrating sieving apparatus for smooth flow of powder in powder spray equipments, the apparatus comprising:

a powder pump assembly having a suction port for sucking the powder from a powder container through a suction path of a powder suction tube;

a vibrating device connected to the powder pump assembly, wherein the vibrating device is configured for real time sieving of powder just before spraying; and a housing connected to the powder pump assembly suction port and the vibrating device, wherein the housing includes a sieve section and an anti-blinding section, wherein the anti-blinding section includes at least one anti-blinding pellet configured for preventing clogging of the sieve section to ensure continuous flow of freshly sieved smooth flowing powder at the suction port of the powder pump assembly.

2. The vibrating sieving apparatus as claimed in claim 1, wherein the sieve section includes at least one sieve mesh and wherein the at least one anti-blinding pellet is placed between the housing and the at least one sieve mesh.

3. The vibrating sieving apparatus as claimed in claim 1, wherein the sieve section includes an inner sieve mesh and an outer sieve mesh with same or different hole sizes, hole quantity and material, and the anti-blinding section includes a plurality of anti-blinding pellets, wherein the plurality of anti-blinding pellets are placed between the inner sieve mesh and the outer sieve mesh.

4. The vibrating sieving apparatus as claimed in claim 1, wherein the sieve section includes a plate with holes and at least one sieve mesh, and the anti-blinding section includes a plurality of anti-blinding pellets, wherein the plurality of anti-blinding pellets are placed between the plate and the at least one sieve mesh.

5. The vibrating sieving apparatus as claimed in claim 1, wherein a plurality of prongs are connected to the sieve section and the anti-blinding section by rigid or flexible connector, to assist in breakage of lumped or coagulated powder thereby presenting less lumped or un-lumped powder from the sieve section and anti-blinding section to the entry port of the suction tube.

6. The vibrating sieving apparatus as claimed in claim 1, wherein the sieve section and the anti-blinding section are connected to a suction end of the powder pump assembly to ensure that all the powder being sucked in by the powder pump assembly of the powder spray equipment is forced to move through the sieve section and thereby get sieved.

7. The vibrating sieving apparatus as claimed in claim 1, wherein the sieve section includes at least one sieve mesh and the anti-blinding section includes at least one anti-blinding pellet which jumps within the confines of a zone having the at least one sieve mesh, and wherein a vibrating motion causes the pellet(s) to bounce around and hit or vibrate the sieve section and anti-blinding section thereby dislodging any stuck powder and impurity particles clinging to or within the fine holes of the at least one sieve mesh to ensure continuously self cleaning of the vibrating apparatus sieves for ensuring clean, freshly sieved powder to enter the suction port of the powder pump assembly.

8. The vibrating sieving apparatus as claimed in claim 1, wherein the at least one vibrating sieving apparatus is placed inside the powder container and connected to a rigid or flexible powder suction tube.

9. The vibrating sieving apparatus as claimed 1, wherein the at least one vibrating device is built with the suction path of the powder suction tube for the powder to be sucked in by the powder pump assembly or is connected to the powder suction tube of the powder pump assembly or is in sealed construction to enable it to be immersed within the powder.

10. The vibrating sieving apparatus as claimed in claim 1, wherein the at least one vibrating sieving apparatus is placed outside the powder container and connected to a rigid or flexible powder suction tube.

11. The vibrating sieving apparatus as claimed in claim 1, wherein the vibrating device is one of pneumatic, ultrasonic or mechanical, and wherein the vibrating device is one of conical, cylindrical, rectangular or cuboid in shape, and is made partially or wholly of a different material either metallic or non-metallic.

12. The vibrating sieving apparatus as claimed in claim 1, wherein a magnetic zone is provided in the suction path to trap ferrous particles which may pass through the anti-blinding section.

13. The vibrating sieving apparatus as claimed in claim 1, wherein the powder pump assembly is integrated with the vibrating sieving device.

* * * * *